US007291098B1

(12) United States Patent
Krull

(10) Patent No.: US 7,291,098 B1
(45) Date of Patent: Nov. 6, 2007

(54) EXERCISE DUMBBELL METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 7 days.

(21) Appl. No.: 11/410,774

(22) Filed: Apr. 25, 2006

Related U.S. Application Data

(60) Provisional application No. 60/677,150, filed on May 3, 2005.

(51) Int. Cl.
*A63B 21/075* (2006.01)

(52) U.S. Cl. ..... 482/107; 482/108

(58) Field of Classification Search ..... 482/92–94, 482/98, 106–109
See application file for complete search history.

(56) References Cited

U.S. PATENT DOCUMENTS

| | | | | |
|---|---|---|---|---|
| 4,529,198 | A * | 7/1985 | Hettick, Jr. | 482/104 |
| 5,876,313 | A * | 3/1999 | Krull | 482/98 |
| 6,261,022 | B1 * | 7/2001 | Dalebout et al. | 482/107 |
| 6,416,446 | B1 * | 7/2002 | Krull | 482/108 |
| 6,422,979 | B1 * | 7/2002 | Krull | 482/98 |
| 6,500,101 | B1 * | 12/2002 | Chen | 482/107 |
| 6,540,650 | B1 * | 4/2003 | Krull | 482/107 |
| 6,749,547 | B2 * | 6/2004 | Krull | 482/106 |
| 6,899,661 | B1 * | 5/2005 | Krull | 482/107 |
| 6,974,405 | B2 * | 12/2005 | Krull | 482/107 |
| 7,014,598 | B2 * | 3/2006 | Fenelon et al. | 482/107 |
| 7,060,011 | B1 * | 6/2006 | Krull | 482/107 |
| 7,066,867 | B2 * | 6/2006 | Krull | 482/108 |
| 7,090,625 | B2 * | 8/2006 | Chermack | 482/108 |
| 7,121,988 | B2 * | 10/2006 | Walkerdine | 482/106 |
| 7,137,932 | B2 * | 11/2006 | Doudiet | 482/107 |
| 2004/0005968 | A1 * | 1/2004 | Crawford et al. | 482/106 |
| 2004/0198569 | A1 * | 10/2004 | Sanford-Schwentke et al. | 482/108 |
| 2005/0227831 | A1 * | 10/2005 | Mills et al. | 482/106 |

* cited by examiner

*Primary Examiner*—Victor K Hwang

(57) ABSTRACT

An exercise dumbbell includes a handle member and weight plates maintained in spaced relationship at opposite ends thereof. Weight selectors are rotatable into and out of engagement with different combinations of the weight plates to secure a desired amount of mass to the handle. The weight selectors occupy respective upwardly closed notches in the weights to secure the weights to the handle member. Different arrangements may be used to bias the weight selectors toward desired orientations relative to the weight plates, and/or to lock the weight selectors in desired orientations relative to the weight plates.

20 Claims, 9 Drawing Sheets

EXERCISE DUMBBELL METHODS AND APPARATUS

CROSS-REFERENCE TO RELATED APPLICATION

Disclosed herein is subject matter that is entitled to the filing date of U.S. Provisional Application No. 60/677,150, filed on May 3, 2005.

FIELD OF THE INVENTION

The present invention relates to exercise equipment and in a preferred application, to methods and apparatus for adjusting weight on an exercise dumbbell.

BACKGROUND OF THE INVENTION

Past efforts have led to various inventions directed toward adjustable weight exercise devices. Some examples of such efforts in the field of free weights are disclosed in U.S. Pat. No. 3,771,785 to Speyer; U.S. Pat. No. 4,529,198 to Hettick, Jr.; U.S. Pat. No. 4,822,034 to Shields; U.S. Pat. No. 4,284,463 to Shields; U.S. Pat. No. 5,637,064 to Olson et al.; U.S. Pat. No. 5,769,762 to Towley, III et al.; U.S. Pat. No. 5,839,997 to Roth et al.; U.S. Pat. No. 6,033,350 to Krull; U.S. Pat. No. 6,099,442 to Krull; U.S. Pat. No. 6,261,022 to Dalebout et al.; U.S. Pat. No. 6,322,481 to Krull; and U.S. Pat. No. 6,540,650 to Krull. Despite these advances and others in the field of weight lifting equipment, room for continued improvement remains with respect to selecting different combinations of weight for use on exercise dumbbells and the like.

SUMMARY OF THE INVENTION

The present invention provides methods and apparatus involving the movement of mass subject to gravitational force. In a preferred application, the present invention allows a person to adjust weight resistance by securing desired amounts of mass to a handlebar or other weight lifting member. A preferred embodiment of the present invention may be described in terms of exercise dumbbells. One such dumbbell comprises a handle member having a first weight supporting section, a second weight supporting section, and a handle that extends therebetween and defines a longitudinal axis. First weights are sized and configured for engagement by the first weight supporting section, and second weights are sized and configured for engagement by the second weight supporting section. A first weight selector is rotatably mounted on the handle member for rotation into different sectors of a cylindrical cavity defined by aligned notches in the first weights. Similarly, a second weight selector is rotatably mounted on the handle member for rotation into different sectors of a cylindrical cavity defined by aligned notches in the second weights. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
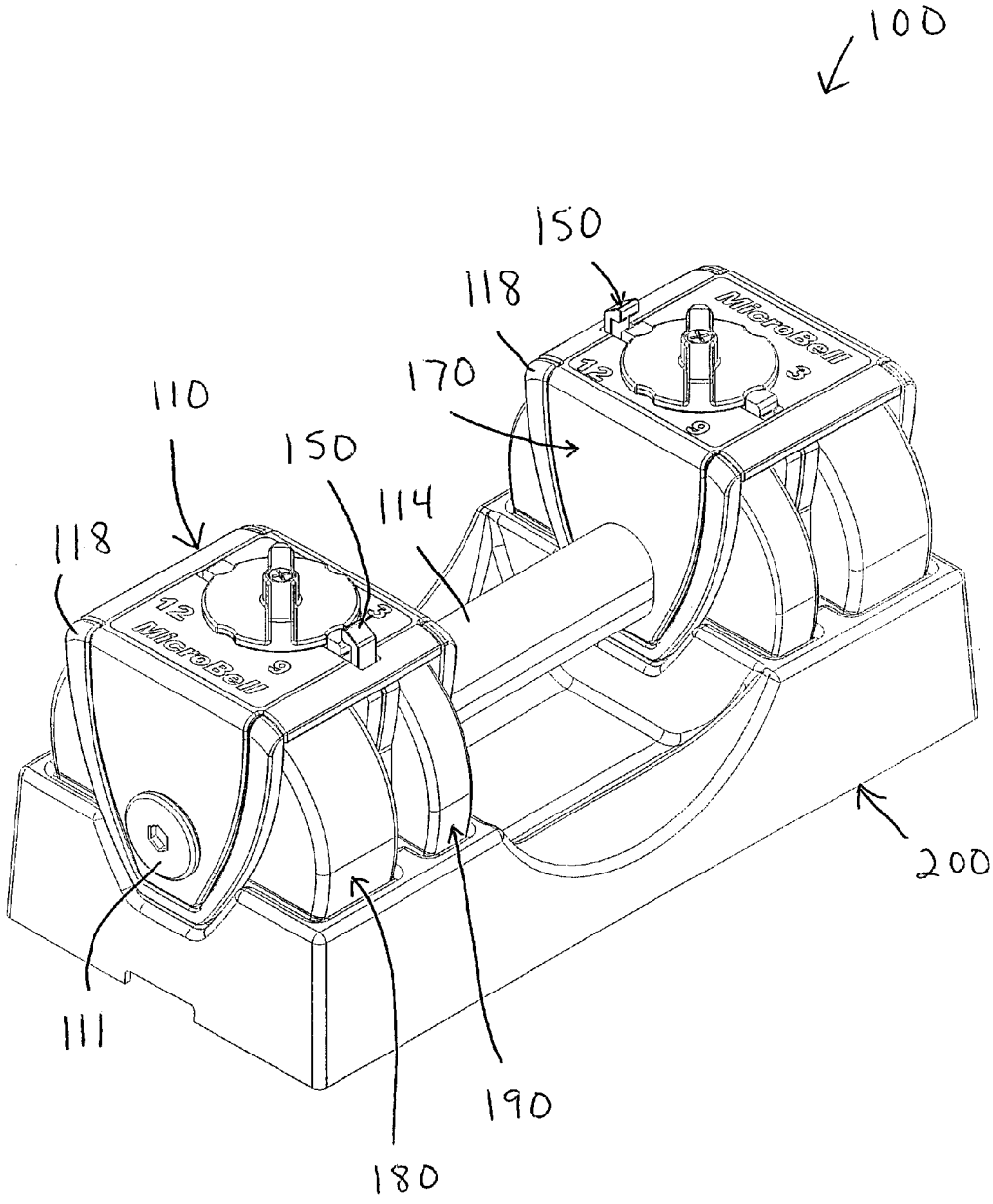
FIG. 1 is a perspective view of an exercise dumbbell system constructed according to the principles of the present invention.

FIG. 1 shows an exercise dumbbell system 100 constructed according to the principles of the present invention. Generally speaking, the dumbbell system 100 includes a weight lifting member or handle member 110, a plurality of weight plates 180 and 190 that are selectively secured to the handle member 110, and a base or cradle 200 that supports the other components when not in use.

Figure 2:
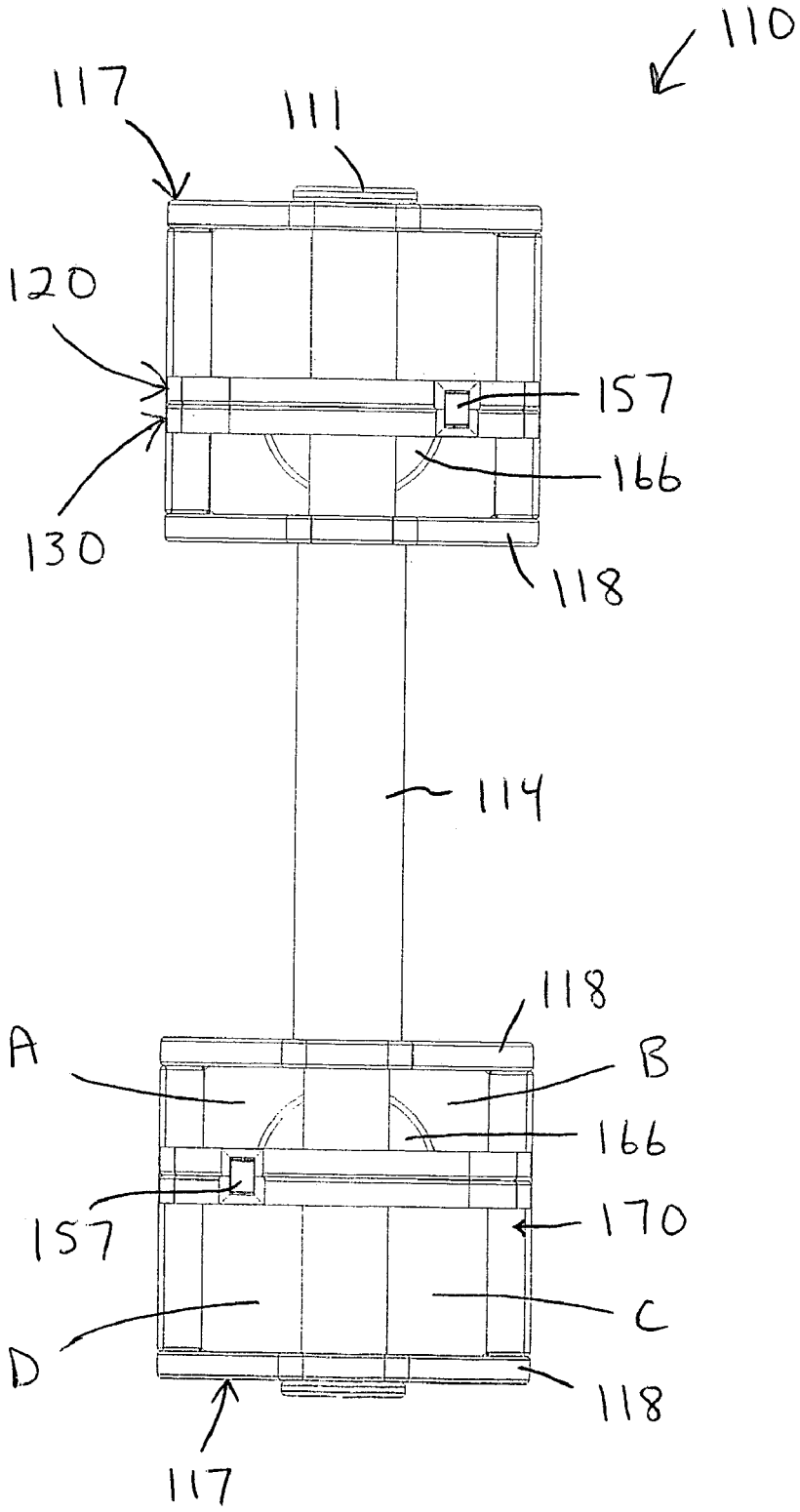
FIG. 2 is a bottom view of a handle member that is a component of the dumbbell system of FIG. 1.
Figure 4:
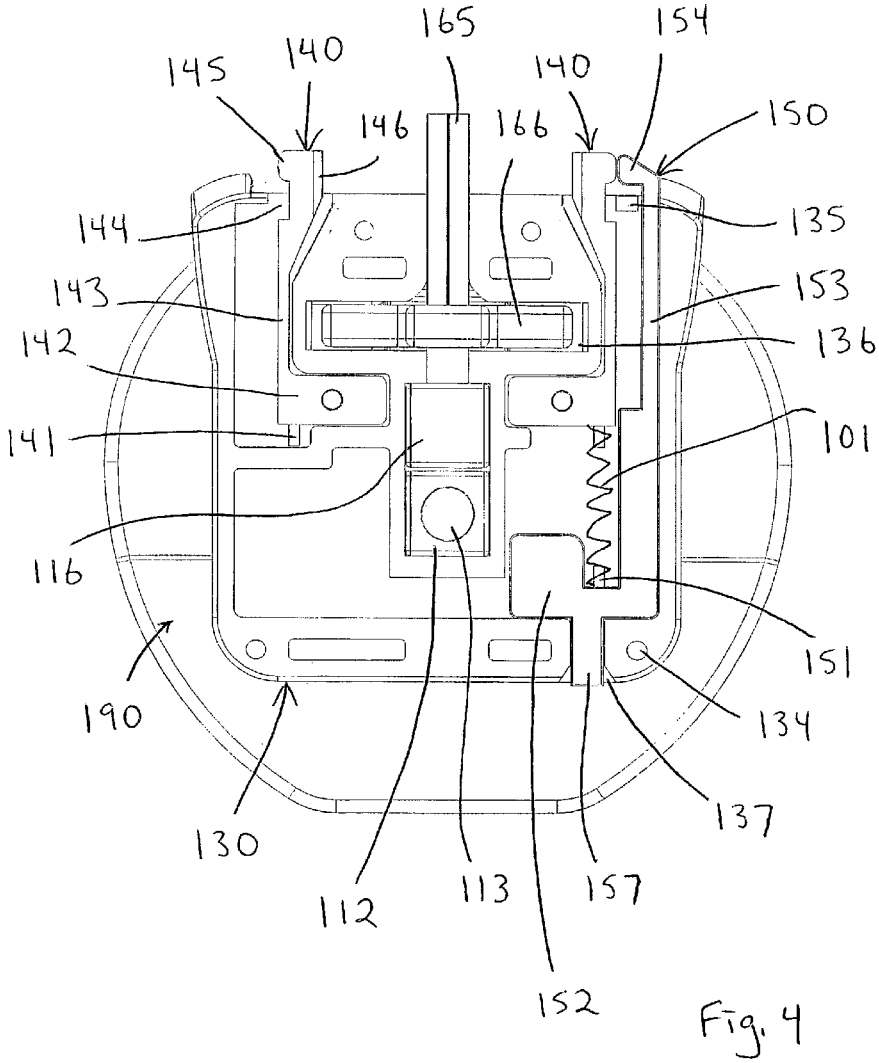
FIG. 4 is an end view of the dumbbell system of FIG. 1 with the weight cradle and some parts of the handle member removed to better illustrate other parts.

The handle member 110 is shown by itself in FIG. 2. Generally speaking, the handle member 110 includes an intermediate handle or hand grip 114, and first and second weight supporting sections 117 at opposite ends of the handle 114. FIG. 4 shows a solid steel bar 112 that extends through the handle 114 and both weight supporting sections 117. Threaded holes 113 in the ends of the bar 112 receive respective end bolts 111, as further described below. FIG. 4 also shows one of two solid steel bar segments 116 that rest on top of the bar 112, and extend through respective weight supporting sections 117, but not through the handle 114.

Figure 5:
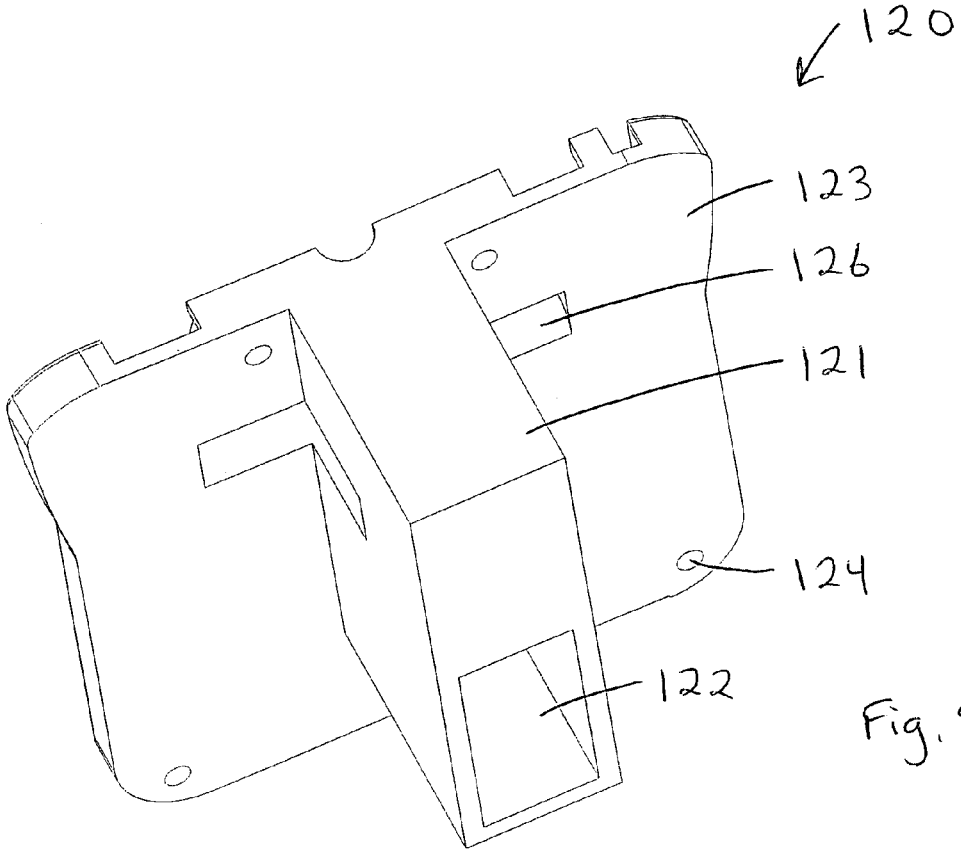
FIG. 5 is a perspective view of a spacer that is a part of the handle member of FIG. 2.

Each weight supporting section 117 includes first and second spacer members 120 and 130 that are preferably injection molded plastic parts. One of the spacer members 120 is shown by itself in FIG. 5. Each spacer member 120 includes a hub portion 121 that spans a respective weight plate 180, and a plate portion 123 that bears against the face of a respective weight plate 180. An opening 122 extends through both portions 121 and 122 of the spacer member 120 to receive the bars 112 and 116. The spacer members 130 are mirror images of the spacer members 120, except that the respective hub portions 131 are shorter (because they span respective weight plates 190, which are relatively thinner). FIG. 4 includes an opposite end view of one of the spacers 130.

Respective spacer members 120 and 130 are secured to one another by means of fasteners (preferably screws and nuts) via holes 124 in the spacer members 120 and aligned holes 134 in the spacer members 130. As suggested by FIG. 4, the interconnected spacer members 120 and 130 cooperate to define openings or compartments that accommodate other parts of the handle member 110, as further discussed below.

Among other things, compartments are formed in opposite sides of the spacer members 120 and 130 to accommodate opposing bias members 140, which are preferably injection molded plastic parts. Each bias member 140 includes a base 142 that is configured to occupy a fixed location inside the spacer members 120 and 130, a relatively thin, leaf spring portion 143 that extends upward from the base 142, and a head 145 connected to an upper end of the leaf spring portion 143. The heads 145 have respective, opposing surfaces 146 that are configured to nest inside diametrically opposed notches 164 in respective knobs 161, as further described below. A notch 144 is formed in an opposite side of the head 146 to provide clearance relative to a tab 135 provided on one side of the spacer member 130 (and relative to an aligned tab on the spacer member 120) for reasons described below. Also, a peg 141 extends downward from the base 142 to register with a helical coil spring 101 on the same one side of the spacer member 130.

FIG. 4 also shows a plunger member 150 disposed within a compartment on the same one side of the spacer member 130. The plunger member 150 is preferably an injection molded plastic part. The plunger member 150 includes a base 152 that is configured and arranged to slide up and down between opposing sidewalls inside the spacer members 120 and 130. A relatively thin stem portion 153 extends upward from the base 152, and a head 154 is connected to an upper end of the stem portion 153. The tabs (including tab 135) help guide the stem portion 153 along a desired path relative to the spacer members 120 and 130. A peg 151 extends upward from the base 152 and aligns with the peg 141 on the bias member 140 to register with an opposite end of the helical coil spring 101. Also, for reasons further discussed below, a post 157 extends downward from the base 152, and is accessible via a chamfered opening 137 defined by the spacer members 120 and 130. The spring 101 is in compression and biases the base 152 of the plunger 150 away from the base 142 of the bias member 140 (to the position shown in FIG. 4).

Slots 126 and 136 are formed in respective spacer members 120 and 130 to accommodate a selector plate 166, which is preferably a steel part. Each selector plate 166 is moved downward onto an upper, keyed portion a respective steel shaft 165, until it rests on top of a lower, non-keyed portion, and then it is secured in place by welding or other suitable means. The lower portion of each shaft 165 is cylindrical and inserts into a hole in a respective bar segment 116. The bar segment 116 and the spacer members 120 and 130 cooperate to support the shaft 165 for rotation relative thereto.

Figure 6:
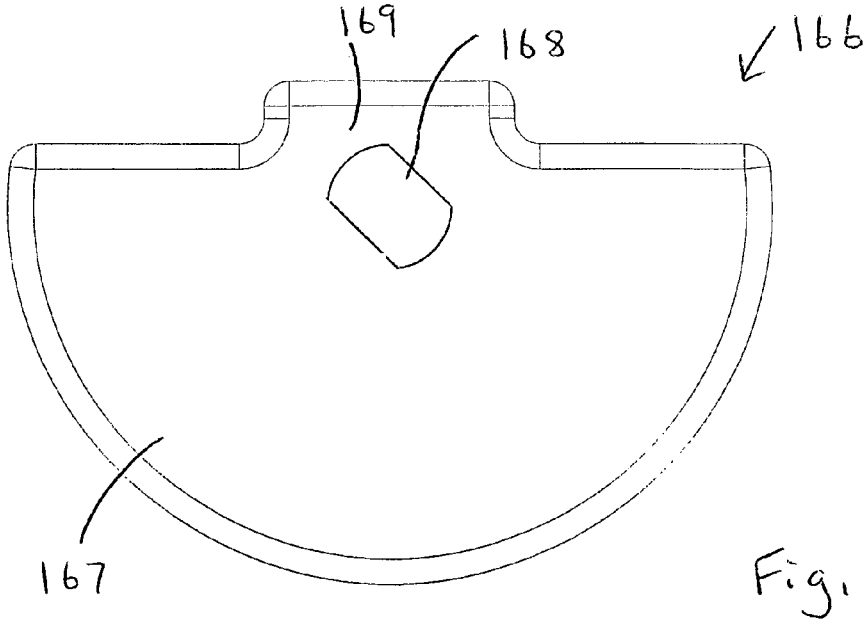
FIG. 6 is a top view of a weight selector that is a part of the handle member of FIG. 2.

One of the selector plates 166 is shown by itself in FIG. 6. Each selector plate 166 includes a semi-circular portion 167, and a keyed opening 168 extending through the plate 166 proximate the center of the semi-circular portion 167. Additional material is preferably provided about the side of the opening 168 opposite the semi-circular portion 167, thereby defining a hub portion 169.

As mentioned above, a respective knob 161 is secured to an upper end of each shaft 165. Each knob 161 includes a beam portion 162 that facilitates rotation of the knob 161, and that serves as an indicator relative to weight indicia 106 on the handle member 110. Each knob 161 also includes a disc portion 163 having circumferentially spaced notches 164 formed therein to receive the heads 146 of the bias members 140, as noted above.

Figure 7:
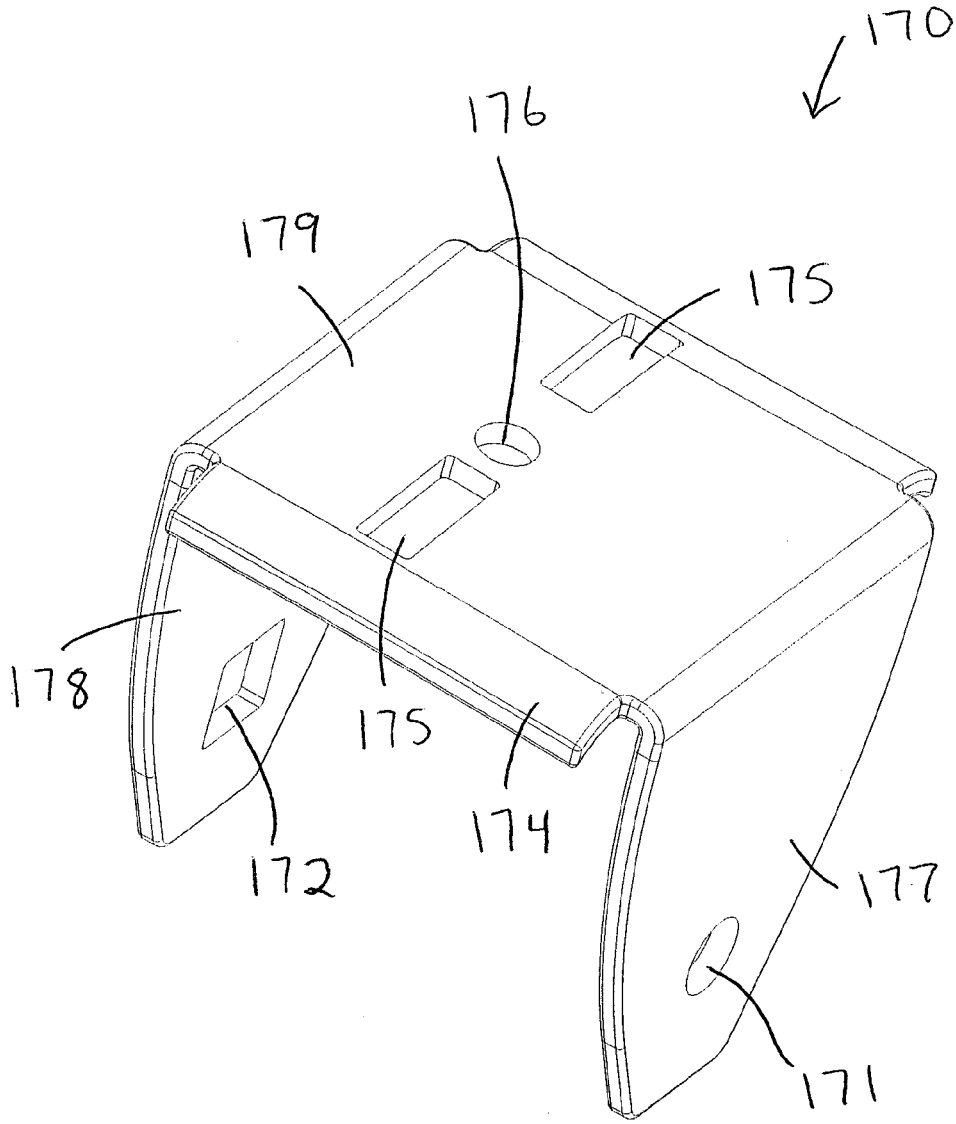
FIG. 7 is a perspective view of a U-shaped plate that is a part of the handle member of FIG. 2.

Each weight supporting section 117 also includes a generally U-shaped plate or housing 170 that is preferably a stamped piece of sheet metal. One such housing 170 is shown by itself in FIG. 7. The housing 170 includes an inner end 178 having a square hole 172 formed therein to accommodate passage onto the bar 112, and an outer end 177 having a smaller, circular hole 171 formed therein to accommodate the shaft of a respective end bolt 111. The housing 170 also has a top portion 179 that extends between the two ends 178 and 177, and that has opposite side flanges 174 that extend outward and downward. A central hole 176 is formed through the top portion 179 to accommodate the shaft 165. Also, rectangular openings 175 extend through the top portion 179 to accommodate the bias members 140 and the plunger member 150.

The weight supporting sections 117 also include opposite end caps 118 that are preferably injection molded plastic parts. The end caps 118 fit between the ends 178 and 177 of the housing 170 and the hub portions 121 and 131 of respective spacer members 120 and 130. The end caps 118 are preferably configured to overlie or guard the edges of a respective end 178 or 177 of the housing 170, as well as respective ends of the opposite side flanges 174. In other words, each end 178 and 177 of the housing 170 nests inside a recess in a respective end cap 118.

Each weight supporting section 117 is assembled by inserting the lower end of the shaft 165 into the bar segment 116, sliding the spacer members 120 and 130 onto opposite ends of the bar segment 116, arranging the bias members 140, the plunger member 150, and the spring 101 as shown in FIG. 4, and then securing the opposing spacer members 120 and 130 together. The end caps 118 are then aligned with the hub portions 121 and 131 of respective spacer members 120 and 130, and the housing 170 is fitted over the aforementioned parts. Then, these "sandwiched" parts are moved onto an end of the bar 112, and the end bolt 111 is inserted through the hole 171 in the housing 170 and threaded into the end of the bar 112. A sticker 107 is preferably secured to the top portion 179 of the housing 170 before the knob 161 is secured to the shaft 165. The fully assembled handle member 110, with the handle 114 "sandwiched" between the two weight supporting sections 117, is preferably designed to weigh three pounds.

Figure 8:
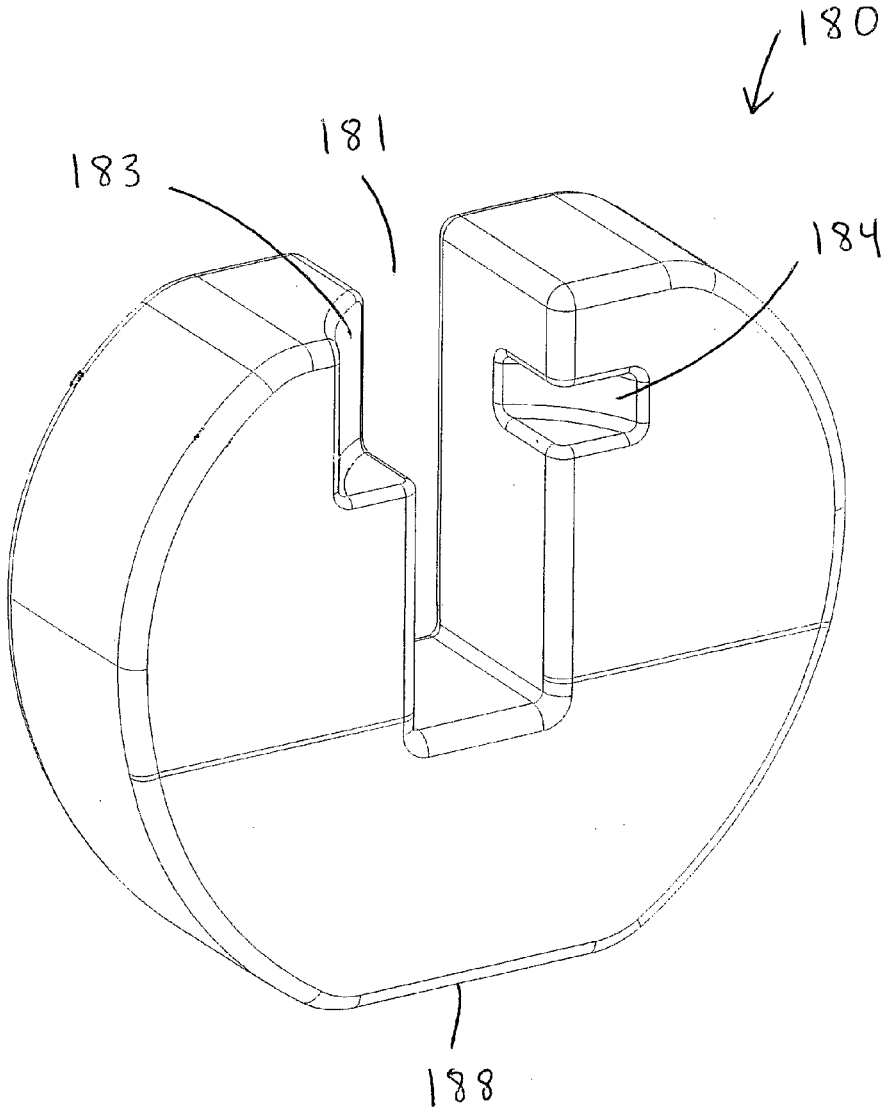
FIG. 8 is a perspective view of a relatively large weight plate that is a component of the dumbbell system of FIG. 1.

FIG. 8 shows one of the weight plates 180 by itself. The weight plate 180 is preferably a cast metal part that weighs three pounds. The weight plate 180 has a central, upwardly open slot 181 that extends through the depth of the plate, and is sized and configured to receive the hub portion 121 on the spacer member 120. An upwardly open notch 183 is formed in the plate 180 and intersects a first side of the slot 181. An upwardly closed notch 184 is also formed in the plate and intersects an opposite, second side of the slot 181. The plate 180 has a lower end 188 that is bounded by a flat surface.

Figure 9:
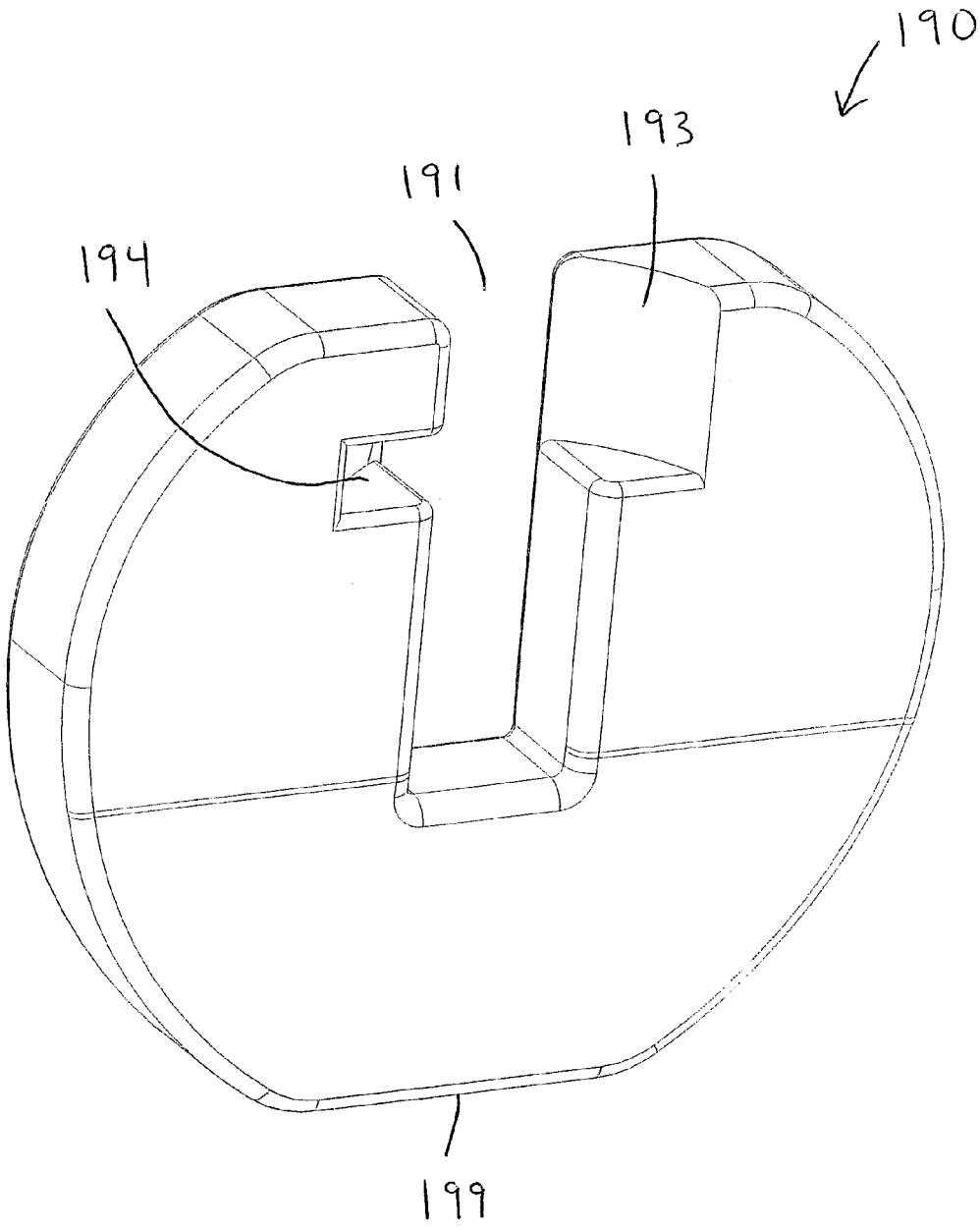
FIG. 9 is a perspective view of a relatively small weight plate that is a component of the dumbbell system of FIG. 1.

FIG. 9 shows one of the weight plates 190 by itself. The weight plate 190 is preferably a cast metal part that weighs one and one-half pounds. The weight plate 190 has a central, upwardly open slot 191 that extends through the depth of the plate, and is sized and configured to receive the hub portion 131 on the spacer member 130. An upwardly open notch 193 is formed in the plate 190 and intersects a first side of the slot 191. An upwardly closed notch 194 is also formed in the plate and intersects an opposite, second side of the slot 191. The plate 190 has a lower end 199 that is bounded by a flat surface.

The plates 180 and 190 are arranged with their respective notches opening toward one another in a manner that defines a cylindrical cavity, with the upwardly open notches 183 and 193 adjacent one another, and the upwardly closed notches 184 and 194 adjacent one another. As shown in FIG. 2, each weight supporting section 117 on the handle member 110 defines four sectors or quadrants A-D through which the selector plate 166 rotates. Each sector A-D coincides with a respective one of the notches in the weight plates 180 and 190. The notches 164 in the knob 161 encourage the selector plate 166 to occupy only two adjacent sectors A-D for any given weight setting.

Figure 3:
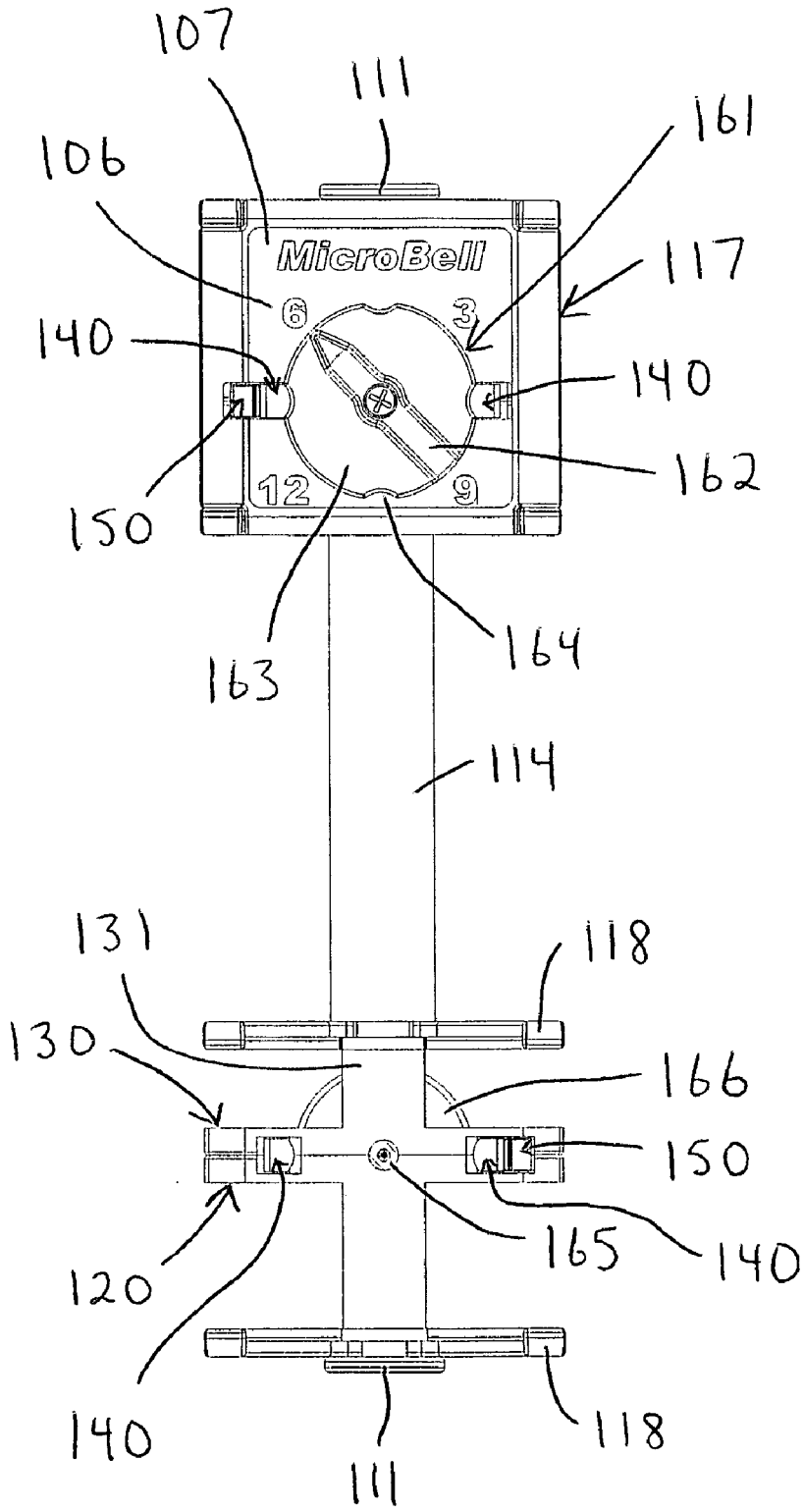
FIG. 3 is a top view of the handle member of FIG. 2 with certain parts removed from one end thereof to better illustrate other parts.

When the system 100 is arranged in the rest position shown in FIG. 1, and the selector plate 166 is rotated to an orientation occupying sector B, the selector plate 166 occupies the upwardly closed notch 194 in the smaller weight plate 190, thereby engaging the weight plate 190 to be lifted together with the handle member 110. Similarly, when the system 100 is arranged in the rest position shown in FIG. 1, and the selector plate is rotated to an orientation occupying sector C, the selector plate 166 occupies the upwardly closed notch 184 in the larger weight plate 180, thereby engaging the weight plate 180 to be lifted together with the handle member 110. FIGS. 1-3 show the knobs 161 set at six pounds, and the selector plates 166 occupy sectors A and B (and both notches 193 and 194 in respective smaller weight plates 190), thereby adding three pounds to the three-pound handle member 110.

Figure 10:
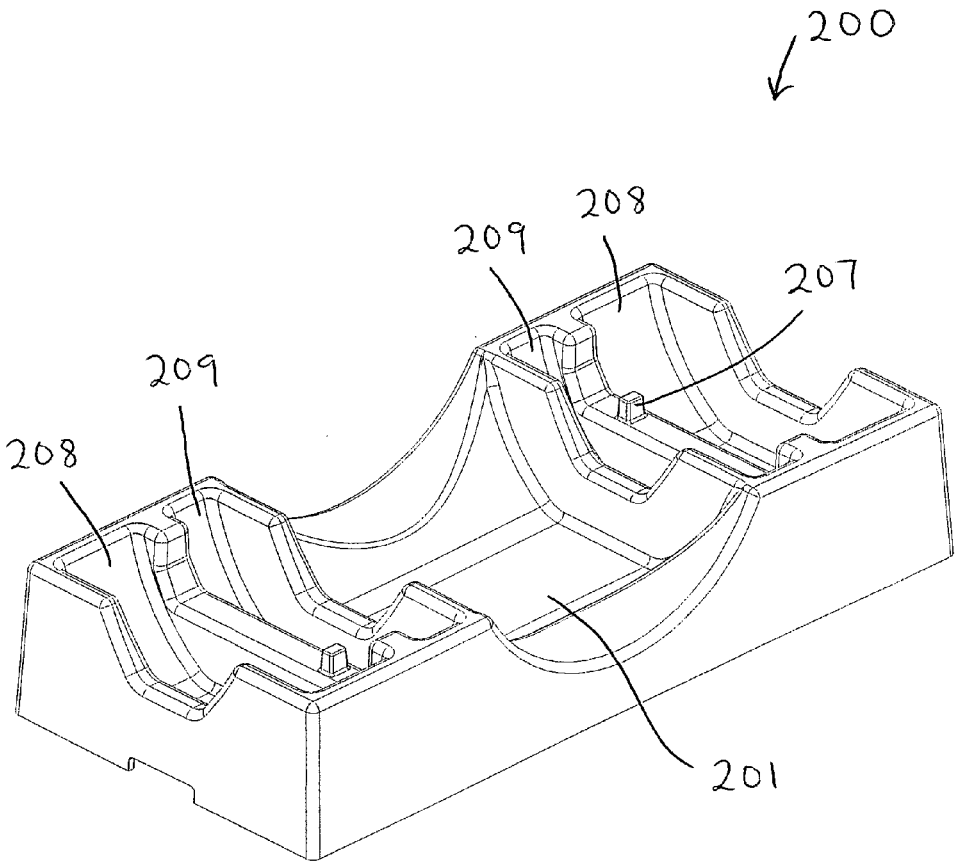
FIG. 10 is a perspective view of a weight cradle that is a component of the dumbbell system of FIG. 1.

FIG. 10 shows a weight cradle or base 200 that supports the weight plates 180 and 190 and the handle member 110 when not in use. The base 200 defines upwardly opening compartments 208 and 209 to accommodate respective weight plates 180 and 190 in the same relative positions as the handle member 110, as well as a central upwardly opening compartment 201 to accommodate positioning of a person's hand about the handle 114. On each sidewall disposed between adjacent compartments 208 and 209, a nub or peg 207 projects upward and aligns with a respective post 157 on the handle member 110.

When the system is arranged in the rest position shown in FIG. 1, the plunger posts 157 engage the nubs 207, and the weight of the handle member 110 overcomes the force of the springs 101 to push the plunger heads 154 upward out of alignment with the bias member heads 145, thereby accommodating rotation of the knobs 161 (by providing clearance for deflection of respective bias members 140). When the handle member 110 is lifted from the base 200, the springs 101 urge the plunger members 150 back toward the position shown in FIG. 4, thereby locking the knobs 161 against rotation (by blocking deflection of respective bias members 140).

The subject invention has been described with reference to a preferred embodiment with knowledge that various improvements, modifications, and/or substitutions may be made thereto. For example, other arrangements may be used (instead of the base 200) to support the weight plates when not in use. Some such arrangements are disclosed in the patents identified in the Background of the Invention, which are incorporated herein by reference (both for purposes of providing additional information about alternative weight supporting arrangements, and for providing additional information about other aspects of dumbbells constructed according to the principles of the subject invention).

Different arrangements and/or combinations may be used to bias the knobs 161 toward desired orientations and/or to lock the knobs 161 in desired orientations. For example, although the preferred embodiment is shown with a single plunger member 150 per weight supporting section 117, a second plunger member 150 may be added to each section 117 as a mirror image relative to the first. Also, the plunger members 150 may require manual operation, as opposed to automatic operation associated with docking the handle member 110 on the base 200. Alternatively, the invention may be practiced without any plunger members 150, in which case the knobs 161 are simply biased against rotation at all times. Yet another alternative is to use locking members (such as plunger members 150) to the exclusion of biasing members (such as bias members 140). Yet another option is to integrate both functions into a single part.

In addition to using different combinations of the plunger members 150 and/or the biasing members 140, different arrangements may be used to perform one or both of these functions, including coil springs, leaf springs, and torsional springs, which may be arranged to directly or indirectly engage the knobs, the selector shafts, and/or the selector plates to bias and/or lock the selector plates in desired orientations relative to the handle member.

Persons skilled in the art will also recognize that the present invention may be implemented with different sizes and/or quantities of weight plates. If three plates are used at each end of the dumbbell, for example, then the selector shaft is preferably centered relative to the middle weight.

The present invention may also be described in terms of various methods relative to the apparatus disclosed herein. For example, the present invention may be described in terms of a method of adjusting weight resistance to exercise, including the steps of providing a first weight and a second weight that cooperate to define a cylindrical cavity having at least four sectors, including an upwardly open first sector defined by the first weight, an upwardly closed second sector defined by the first weight, an upwardly open third sector defined by the second weight, and an upwardly closed fourth sector defined by the second weight; supporting the first weight and the second weight in alignment with one another to define the cylindrical cavity; providing a liftable member and a weight selector rotatably mounted on the liftable member for rotation inside the cavity; and selectively rotating the weight selector into different combinations of adjacent cavity sectors to selectively secure a desired amount of weight to the liftable member.

Recognizing that this disclosure will enable persons skilled in the art to derive additional modifications, improvements, and/or applications that nonetheless embody the essence of the invention, the scope of the present invention is to be limited only to the extent of the following claims.

What is claimed is:

1. A method of adjusting weight resistance to exercise, comprising the steps of:

positioning a first weight and a second weight in side-by-side alignment with one another to define a cylindrical cavity having at least four sectors, including an upwardly open first sector defined by within a platform of the first weight, an upwardly closed second sector defined within the platform of the first weight, an upwardly open third sector defined within a platform of the second weight, and an upwardly closed fourth sector defined within the planform of the second weight;

positioning a liftable member relative to the first weight and the second weight in such a manner that a rotatable weight selector on the liftable member occupies the cavity;

rotating the weight selector to occupy the first sector and the second sector and thereby secure only the first weight to the liftable member;

rotating the weight selector to occupy the second sector and the third sector and thereby secure both the first weight and the second weight to the liftable member;

rotating the weight selector to occupy the third sector and the fourth sector and thereby secure only the second weigh to the liftable member; and rotating the weight selector to occupy the fourth sector and the first sector and thereby release both the first weight and the second weight from the liftable member.

2. The method of claim 1, wherein the first recited positioning step involves positioning each said weight on a base that is configured to maintain the first weight and the second weight in said side-by-side alignment.

3. The method of claim 2, wherein the weight selector is locked against unintentional rotation relative to the liftable member when the liftable member is removed from the base, and the second recited positioning step automatically unlocks the weight selector for rotation relative to when the liftable member.

4. The method of claim 1, wherein the weight selector is biased against unintentional rotation relative to the liftable member, and each said rotating step requires application of force sufficient to overcome bias force acting on the weight selector.

5. The method of claim 1, wherein the the second recited positioning step causes both a spacer on the liftable member to be inserted between the first weight and the second weight, and a slot in the liftable member to align with the sectors to accommodate rotation of the weight selector within the cavity.

6. An exercise dumbbell, comprising:

a handle member having a handle that defines a longitudinal axis, a first weight supporting section disposed at a first end of the handle, and a second weight supporting section disposed at an opposite, second end of the handle;

first weights sized and configured to be supported by the first weight supporting section;

second weights sized and configured to be supported by the second weight supporting section;

a first weight selector rotatably mounted on the handle member for selective rotation into upwardly closed notches in the first weights, wherein the first weight selector rotates about a first axis extending perpendicular to the longitudinal axis; and a second weight selector rotatably mounted on the handle member for selective rotation into upwardly closed notches in the second weights, wherein the second weight selector rotates about a second axis extending perpendicular to the longitudinal axis.

7. The exercise dumbbell of claim 6, wherein each said weight selector has a generally semi-circular profile when viewed axially.

8. The exercise dumbbell of claim 6, wherein each of said weights defines a first, upwardly open notch, and a second, upwardly closed notch, and each said notch is configured and arranged to accommodate rotation of a respective said selector therethrough.

9. The exercise dumbbell of claim 6, wherein the first weight selector is keyed to a first shaft, and a first knob is mounted on an upper end of the first shaft, and the second weight selector is keyed to a second shaft, and a second knob is mounted on an upper end of the second shaft.

10. The exercise dumbbell of claim 6, further comprising means for biasing each said weight selector to remain in a desired orientation relative to the handle member.

11. The exercise dumbbell of claim 6, further comprising means for selectively locking each said weight selector in a desired orientation relative to the handle member.

12. The exercise dumbbell of claim 6, further comprising a base sized and configured to support the weights in respective rest positions that align with the weight supporting sections.

13. The exercise dumbbell of claim 12, further comprising a means for selectively locking each said weight selector in a desired orientation relative to the handle member only when the handle member is removed from the base.

14. An exercise dumbbell, comprising:

a handle member having a handle, a first weight supporting section disposed at a first end of the handle, and a second weight supporting section disposed at an opposite, second end of the handle;

first weights sized and configured to be supported by the first weight supporting section, wherein notches in the first weights cooperate to define a first cylindrical cavity having upwardly open sectors in the first weights and upwardly closed sectors in the first weights;

second weights sized and configured to be supported by the second weight supporting section, wherein notches in the second weights cooperate to define a second cylindrical cavity having upwardly open sectors in the second weights and upwardly closed sectors in the second weights;

a first weight selector rotatably mounted on the handle member for rotation inside the first cylindrical cavity, and configured to occupy only a fraction of the sectors in any given orientation relative to the handle member; and a second weight selector rotatably mounted on the handle member for rotation inside the second cylindrical cavity, and configured to occupy only a fraction of the sectors in tiny given orientation relative to the handle member.

15. The dumbbell of claim 14, wherein each said weight selector defines a respective rotational axis, and includes a plate having a generally semi-circular shape when viewed axially.

16. The dumbbell of claim 15, wherein each said rotational axis extends perpendicular to a longitudinal axis defined by the handle.

17. The dumbbell of claim 16, wherein the first weight selector is keyed to a first shaft disposed between opposing surfaces on the first weights, and a first knob is keyed to an upper end of the first shaft, and the second weight selector is keyed to a second shaft disposed between opposing surfaces on the second weights, and a second knob is keyed to an upper end of the second shaft.

18. An exercise dumbbell, comprising:

first and second sets of weights, wherein each of the sets of weights includes at least two weights having respective notches that cooperate to define a cylindrical cavity; and a handle member having a handle that defines a longitudinal axis, and first and second weight supporting sections disposed at respective ends of the handle, wherein each of the weight supporting sections includes:

a spacer configured and arranged for insertion between the at least two weights in a respective one of the sets without obstructing the respective said cavity;

a shaft rotatably mounted inside the spacer for rotation about an axis extending lengthwise through a respective said cavity;

a weight engaging member keyed to the shaft, and configured and arranged to rotate inside a respective said cavity and to underlie different combinations of respective said weights as a function of its orientation relative to the handle member; and a knob keyed to the shaft.

19. The dumbbell of claim 18, further comprising biasing means for biasing each said knob toward desired orientations relative to the handle member.

20. The dumbbell of claim 18, further comprising locking means for locking each said knob in desired orientations relative to the handle member.

* * * * *